US005803020A

United States Patent [19]

Palmgren

[11] Patent Number: 5,803,020

[45] Date of Patent: Sep. 8, 1998

[54] RECOVERY BOILER FOR COMBUSTION OF WASTE LIQUORS

[75] Inventor: Anders Palmgren, Ytterby, Sweden

[73] Assignee: Kvaerner Pulping Technologies AB, Karlstad, Sweden

[21] Appl. No.: 319,439

[22] Filed: Oct. 6, 1994

[30] Foreign Application Priority Data

Dec. 29, 1993 [SE] Sweden ..... 9304309

[51] Int. Cl.[6] ..... F22D 1/00

[52] U.S. Cl. ..... 122/7 R; 110/238

[58] Field of Search ..... 110/238, 245; 122/4 D, 7 R

[56] References Cited

U.S. PATENT DOCUMENTS

| | | | |
|---|---|---|---|
| 2,198,446 | 4/1940 | Wilcoxson | 110/238 |
| 2,631,932 | 3/1953 | Patterson et al. | 122/235.11 |
| 2,911,284 | 11/1959 | Hochmuth | 110/238 |
| 3,168,074 | 2/1965 | Kuhner et al. | 110/238 |
| 3,215,099 | 11/1965 | Coulter, Jr. | 110/238 |
| 3,403,642 | 10/1968 | Parkin | 110/238 |
| 3,413,936 | 12/1968 | Matthews | 110/238 |
| 4,014,296 | 3/1977 | Astrom . | |
| 4,462,319 | 7/1984 | Larsen | 110/238 |
| 5,603,803 | 2/1997 | Raak | 110/238 |

*Primary Examiner*—Henry A. Bennett
*Assistant Examiner*—Jiping Lu
*Attorney, Agent, or Firm*—Dorsey & Whitney

[57] ABSTRACT

The invention relates to a recovery boiler for combustion of waste liquors. It comprises a furnace whose base and walls include a multiplicity of liquid-cooled tubes and whose base (21) constitutes a collection point for inorganic substances in molten form, with air and waste liquor being introduced into the furnace and the combustion gases being conveyed upwards in the boiler. The invention is characterized essentially in that the cross-sectional area of the furnace at a first lower level (1) exceeds the cross-sectional area of the furnace at a second level (2) higher up in the furnace.

14 Claims, 5 Drawing Sheets

RECOVERY BOILER FOR COMBUSTION OF WASTE LIQUORS

TECHNICAL FIELD

The present invention relates to an arrangement for combustion of waste liquors which are obtained in connection with cellulose production starting from wood chips or similar material containing lignin.

PRIOR ART

Recovery boilers for combustion of waste liquors have been known for several decades now. They generally consist of a shaft-shaped furnace whose walls to a large extent consist of pipes through which water flows and which in its upper part is also provided with pipe systems for water through-flow and cooling of the flue gases. The concentrated waste liquor, which is also called black liquor, is sprayed in through one or more nozzles in the lower part of the furnace. Air for the combustion of the black liquor is blown in at different levels, as primary air, secondary air, tertiary air or also at a later stage as quaternary air.

In addition to gases such as carbon dioxide, various nitrogen oxides, carbon monoxide, sulphur compounds and water, the combustion also generates molten, inorganic material consisting essentially of sodium salts. This molten matter is collected at the base of the boiler, from which it is allowed to run out in a container and is then re-used. The temperature in the combustion zone in the shaft runs to 1000°–1200° C., and the smelt which is removed has a temperature of 700°–900° C. The flue gases are cooled down to 100–200 degrees before they are discharged from the recovery boiler. The heat which is generated and which is removed from the flue gases is transferred to the water in the pipe systems, whereupon steam is produced which is removed in a steam dome at the top of the boiler, and thereafter the boiler is given a superheater for further raising the steam temperature. The generated steam usually has a pressure of 40–100 bar and a temperature of 400°–500° depending on the construction of the boiler.

The water in the pipes flows upwards by virtue of the steam which is formed by the heat transferred from the flue gases. The water that remains after the steam generation is separated from the steam in the steam dome and is returned to the lower end of the pipes.

The height of recovery boilers usually runs to several tens of meters, for example 30–60 meters, and has a circumference of 10–50 meters, for which reason there is room for a very large number of pipes with a substantial overall length around the shaft and along the base part. For reasons relating to production technology, the recovery boilers have been designed in such a way that walls for roof and base consist of pipes joined together to form plane surfaces. Since these pipes will be joined to each other at a certain distance, it is easier to do this in an automatic manner if they are to form plane surfaces. The recovery boilers therefore consist for the most part of a shaft which is square in cross-section. The shaft is usually suspended in a steel or concrete structure and thus hangs down over the collection container for the molten inorganic chemicals.

TECHNICAL PROBLEM

As has been said, recovery boilers of the abovementioned type have existed for a long time, and they function satisfactorily per se, but they can be improved further, both as regards the operation and the production methods. Thus, among other things, there is an uneven heating of the pipes on the inside along the shaft wall since the pipes which are situated in the corners or near to these are at a greater distance from the central furnace and are not accessible to the same heat radiation as are the pipes which are placed more centrally on the wall. The water which is situated in the corner pipes is therefore converted to steam to a lesser extent than is the water which is situated in the other pipes. Certain pipes have a continuation along the base surface. The pipes which constitute the continuation of the corner pipes along the base part will have a slower through-flow or water since the water in the corner pipes circulates more slowly than in the other pipes, and burn damage, so-called burn-outs, therefore occurs sometimes in these base pipes.

Another problem with the conventional recovery boilers is also that it is easy for small drops of molten, inorganic chemicals to fly upwards in the flue gases on account of the great speed of the flue gases. It can happen that they are then deposited on the upper heating surfaces and impair the cooling of the gas and increase the gas flow resistance.

SOLUTION

It has therefore long been an objective to be able to remedy the abovementioned drawbacks of recovery boilers while at the same time maintaining production methods which include automatic welding, and for this reason a recovery boiler for combustion of waste liquors from cellulose production has been proposed, according to the invention, comprising a furnace whose base and walls include a multiplicity of liquid-cooled tubes and whose base constitutes a collection point for inorganic matter in molten form, with air and waste liquor being introduced into the furnace and the combustion gases being conveyed upwards in the boiler, which recovery boiler is characterized in that the cross-sectional area of the furnace at a first lower level exceeds the cross-sectional area of the furnace at a second level higher up in the furnace, so that the average gas flow speed upwards can be kept lower at the first level than would have been the case if the cross-sectional area had been identical at the first and second levels.

According to the invention, it is expedient for the number of wall tubes at the said first level to be essentially the same as, and preferably identical to, the number of tubes at the said second level.

According to the invention, the recovery boiler is also characterized in that the circumference of the cross-section at the two levels is essentially the same.

The recovery boiler according to the invention can expediently have a cross-section at the second level which exhibits an essentially rectangular, preferably square, shape, and a cross-section at the first level which is polygonal, having more than four sides, preferably six or eight.

In the recovery boiler according to the present invention, the pipes along the walls which run vertically and which are placed in the corners of the wall at the second level will, at the first level, be situated along an unbroken surface and at a shorter distance from a centre line extending vertically in the recovery boiler than at the second level.

The recovery boiler according to the invention can expediently be designed such that the first lower level represents about ¼ of the total height.

The invention is further characterized in that the collection base for the inorganic substances in molten form has the shape of an open, upwardly directed V.

According to the invention, it is expedient for outlets from the base to be arranged at both ends of the V-shaped base.

The recovery boiler according to the present invention is also characterized in that the final part of the cooling of the flue gases is designed in two stages, with the flue gases in the penultimate stage being made to flow downwards along the pipes in a heat exchanger having vertical, water-filled pipes, while in the final stage they are made to flow downwards across the pipes in a heat exchanger having horizontally positioned pipes.

According to the invention, it is expedient for the final stage to have an inlet directly connected to the outlet of the penultimate stage.

According to the invention, it is expedient for the final stage to be designed as several pipe assemblies, preferably three or more, arranged one after the other in the direction of the flue gases.

According to the invention, one of the final stages in the cooling of the flue gases can be supported from below instead of being suspended.

DESCRIPTION OF THE FIGURES

The invention will be described in greater detail hereinbelow with reference to a preferred embodiment which is shown in the attached figures, in which:

FIG. 4 shows a section through the boiler at the level where the black liquor is sprayed in.

DETAILED DESCRIPTION

Figure 1:
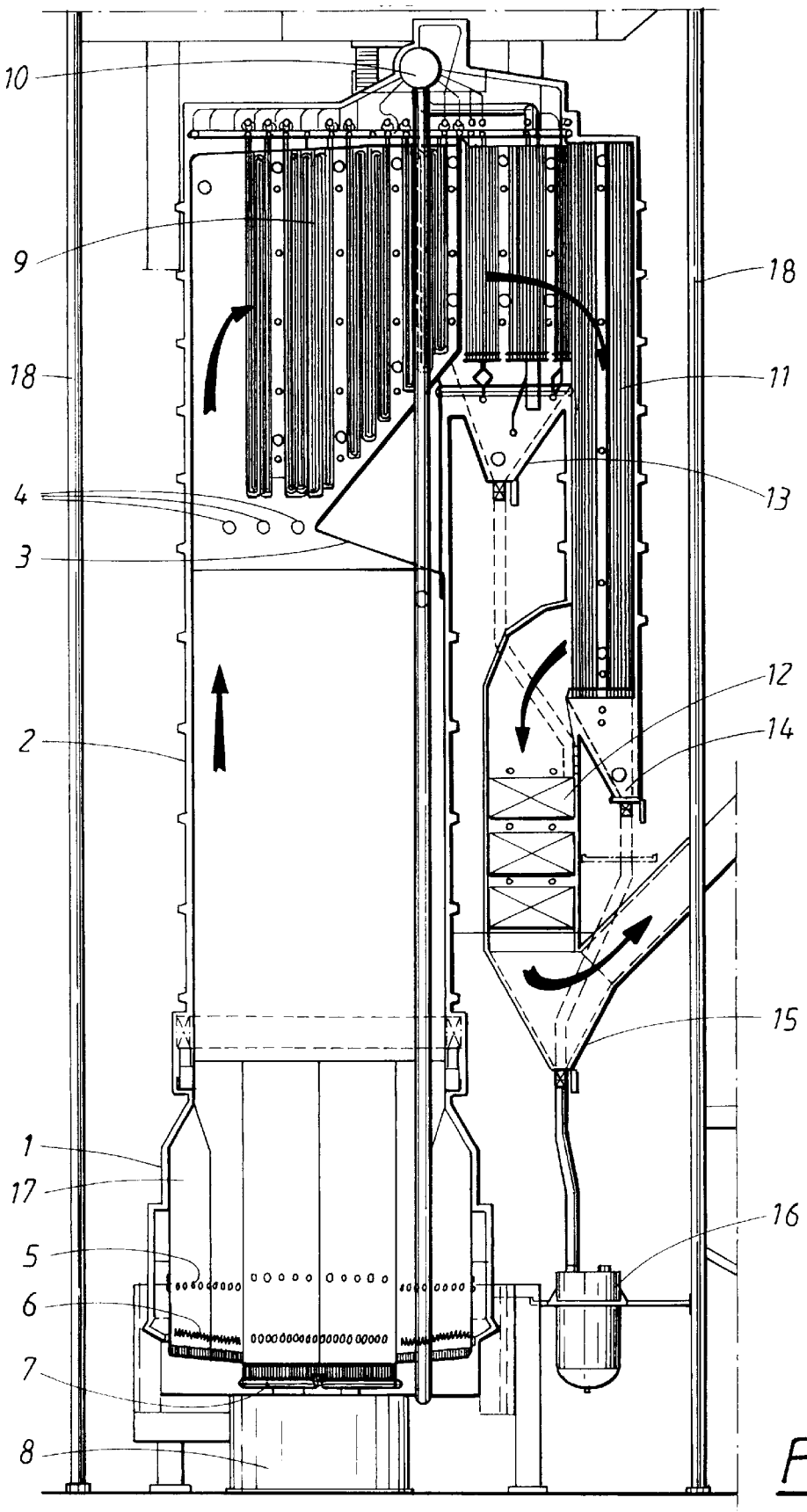
FIG. 1 shows, diagrammatically and in partial cross-section, a recovery boiler according to the invention.

FIG. 1 shows, in section, the main parts of a preferred recovery boiler according to the invention. The boiler consists of a shaft-shaped furnace having a first lower level 1 and a second upper level 2. The second level 2 is of conventional type and has, at its upper end, a constriction, a so-called nose 3. A final set of air injection nozzles 4 for quaternary air is present at this level but is not necessary for the invention. The upper shaft-shaped part 2 of the boiler has been made square in the present case. Pipes for through-flow of water and for heat absorption are arranged on the inside of the whole boiler, but for reasons of simplicity they are not shown in the drawing.

As is evident from the Figure, the lower level 1 is widened in relation to the upper part 2. This level 1 has been made octagonal in the present case, although a hexagon can also be used, or a polygon with more then eight corners, in which respect the lower part approaches a circular shape the more edges there are. What is important is that the lower part 1 has more edges than the upper part 2. The number of edges can be chosen freely. However, an expedient number is eight, since in this way excessively small, plane surfaces need not be formed by the walls. The cross-sectional area of this lower part 1 is consequently greater than the cross-sectional area of the upper part 2, while the circumference of the latter remains the same. Due to the fact that the cross-sectional area is greater than in the upper part 2, the gas speed will be lower in this part, which has, inter alia, the advantage that drops of liquid, particles etc are not so easily drawn upwards by the gas flows. A set of nozzles 5 for secondary air and 6 for primary air have also been arranged in the lower part. The molten chemicals are collected at the base 7 and are allowed to flow out into one or more collection tanks 8 under the boiler.

The black liquor which is to be combusted is introduced into the lower part 1 via nozzles at a level 17 above the secondary air set 5.

Situated above the upper part 2 of the furnace is a cooling system 9 for the flue gases which is of conventional type. This system 9 consists, on the one hand, of suspended pipes through which steam from the so-called steam dome 10 flows, and, on the other hand, of suspended pipes through which water or a mixture of water and steam flows. Steam from the pipes in the furnace is collected in the steam dome 10. Water to the pipes intended to form steam (food water) is also fed into the steam dome 10. The pipes in the cooling system 9 are suspended in a normal manner and are divided up into several assemblies with dust blowers arranged between the assemblies.

As the flue gases pass through the cooling system 9, the gases are cooled. The cooling system 9 ends with an elongate cooling arrangement 11 in which the flue gases can flow along the pipes. The cooling arrangement 11 which will cool the flue gases from about 450° C. constitutes a penultimate stage of the whole cooling system in the boiler. Directly connected to the penultimate stage 11 is a further and final stage 12 which consists of in principle the same heat exchanger as above, but with the pipes placed horizontally in several assemblies in which the gases are made to flow across the pipes. This crosswise flow is more effective than lengthwise flow in respect of the heat transition between the flue gas and the water in the tubes, and in this final stage 12 the gas can be cooled to 100°–200° C. In the drawing, the final stage 12 is made up of three pipe assemblies, but a larger number can also be provided. The reason why the pipes are arranged in different assemblies is that it will be possible for dust blowers to be arranged between the assemblies. It is inevitable that some dust will be carried from the furnace, which dust settles on the pipes and must be removed at regular intervals in order to avoid impaired heat transfer. The dust from dust blowing can either fall directly down in the furnace or can be collected in funnels 13, 14 and 15 and then fall down into a container 16, from which this material is returned to the furnace 1.

It is expedient for the inlet of the final stage 12 of the cooling system to be directly connected to the penultimate stage 11. Cooling medium in the stages 11 and 12 consists of water, so-called feed water, which, when it has been heated, is supplied to the steam dome.

The final stage 12 can also be supported from below and does not therefore have to be suspended.

The whole boiler system is otherwise suspended and is supported by the columns 18 or another suitable structure.

Figure 2:
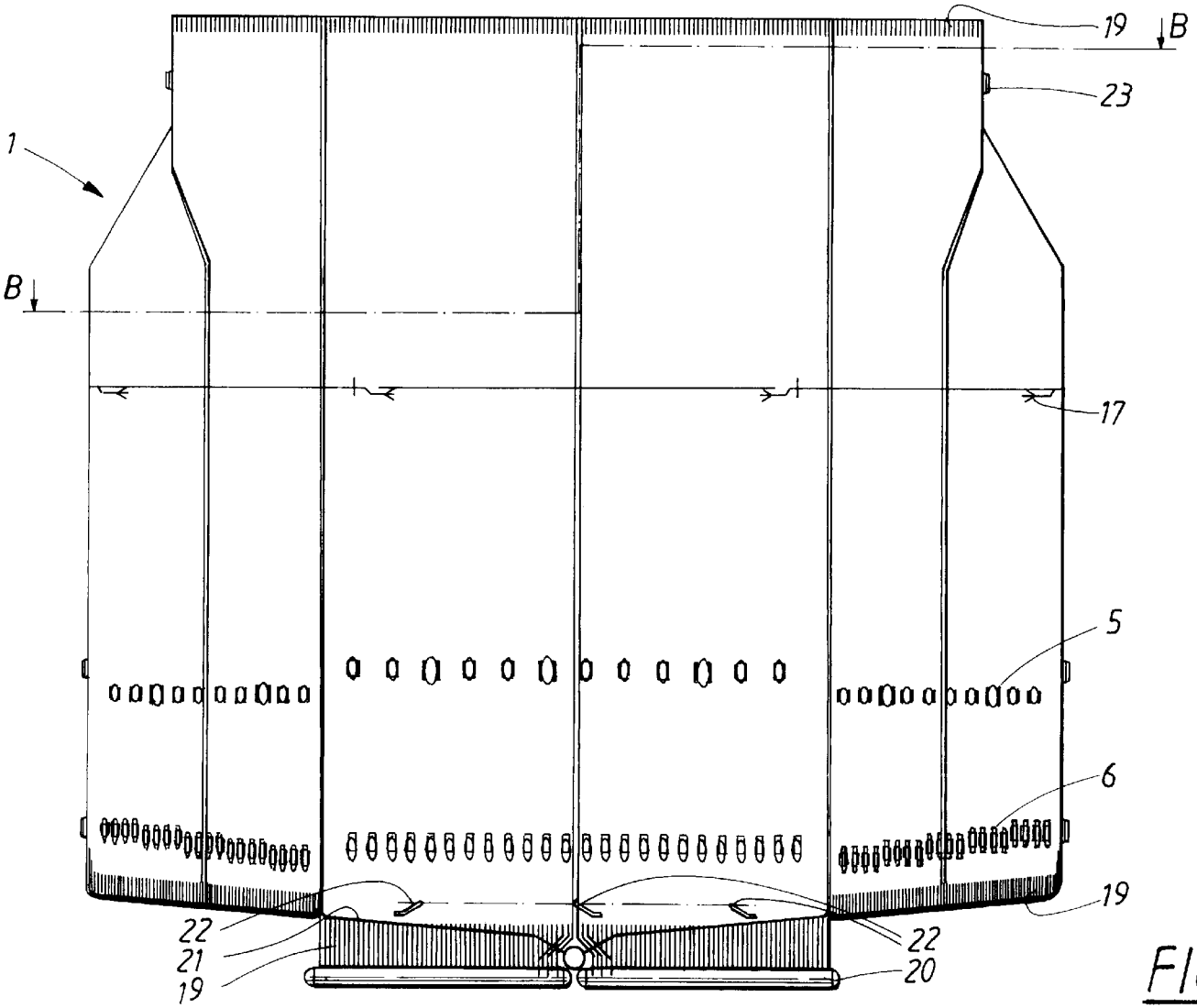
FIG. 2 shows, again diagrammatically and in cross-section, the lower part of the recovery boiler according to FIG. 1 in an enlarged representation.

FIG. 2 shows the lower level 1 of the boiler according to the invention. In the present preferred case this is octagonal. At the upper part and at the base part the cooling pipes 19 are indicated by dashes. These pipes, which are vertical along the walls, execute, at opposite sides in the lower part, a turn to an almost horizontal position along the base. Not all the pipes can be turned in this way and accommodated in one and the same plane, for which reason some of the pipes pass down into a distribution pipe 20.

As is shown in cross-section, the base 21 is V-shaped upwards and has the form of a very open V. The molten inorganic material will therefore be collected in the channel which is formed by this V. This molten material is drained off on both sides of the V through openings 22, which in the present case are three in number on each side. The openings 22 lie slightly above the V base, for which reason a pool of molten material is intentionally left in the base. The injection of primary and secondary air and in addition liquor sprayers are indicated by the same references as in FIG. 1, while the injection of tertiary air takes place at the level 23.

The pipes which are situated in the corners in the upper part 2 of the furnace come not to be situated in any corner in the lower part of the furnace in accordance with the invention. This is shown clearly by FIG. 3 which represents a section along the line b—b in FIG. 2. In this Figure, a corner in the upper part is marked by the reference 24, and the corners in the lower part by the references 25. As is evident from the Figure, the pipes from the corner 24 turn inwards and reach the lower edge 26. There, they are not situated in any corner, but instead approximately centrally on the side However, the octagon is not equilateral, for which reason the pipes do not turn to the same extent. The pipes from the corners 24 of the square thus come to be situated nearer the centre of the furnace in the lower octagonal part than in the upper square part, while, in a corresponding manner, the pipes in the corners 25 in the lower octagonal part come to be situated nearer the centre of the furnace in the upper square part. The corner pipes therefore come to be warmer than if they had remained corner pipes, and the continuation of these pipes horizontally along the base therefore comes to have water flowing through it at a greater speed than if the square cross-sectional form had been kept all the way down. This counteracts the risk of burn damages in the base pipes, so-called burn-outs.

Figure 3:
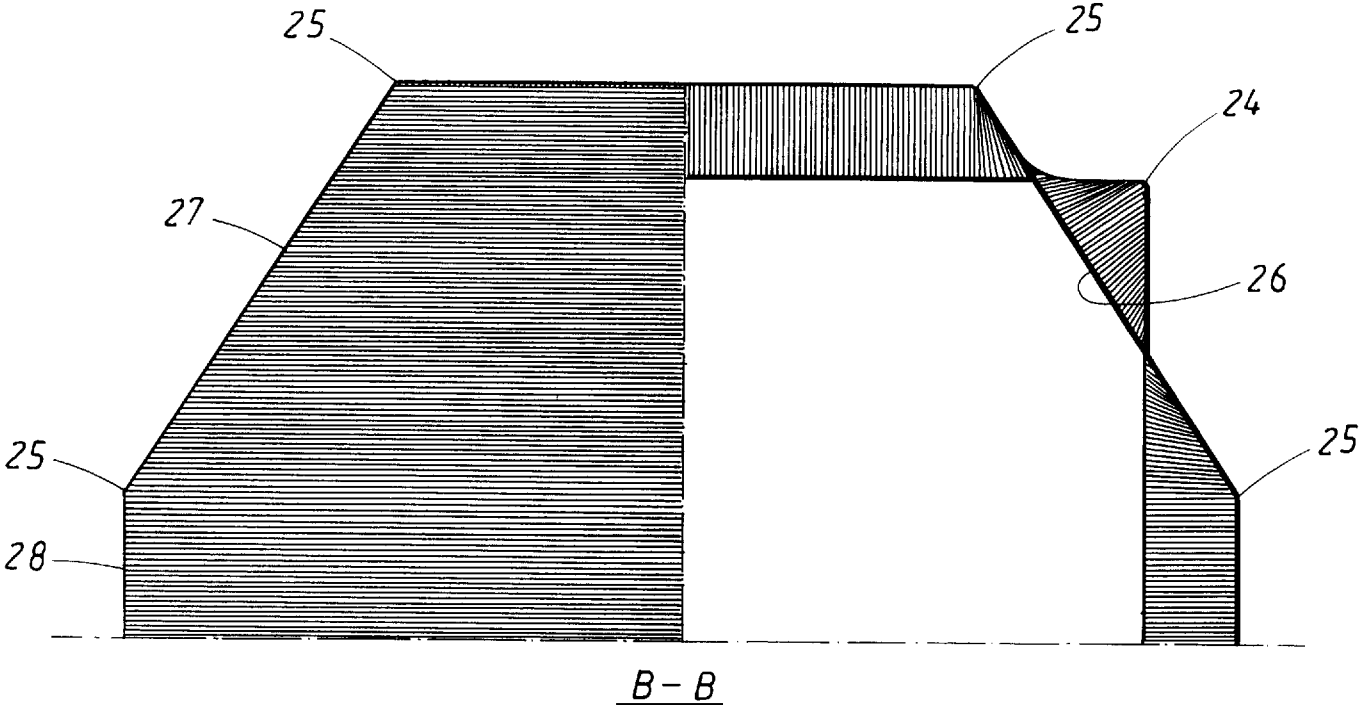
FIG. 3 shows a section along the line B—B in FIG. 2.

The left part of FIG. 3 shows how the base pipes are arranged. The vertical pipes along the sides 27 and 28 are bent in parallel inwards along the base. Since the side 27 has a certain angle with the base pipes, these base pipes, if they have the same external diameters, come to be situated nearer each other from this side than at the side 28 where the pipes are bent straight outwards.

Figure 4:
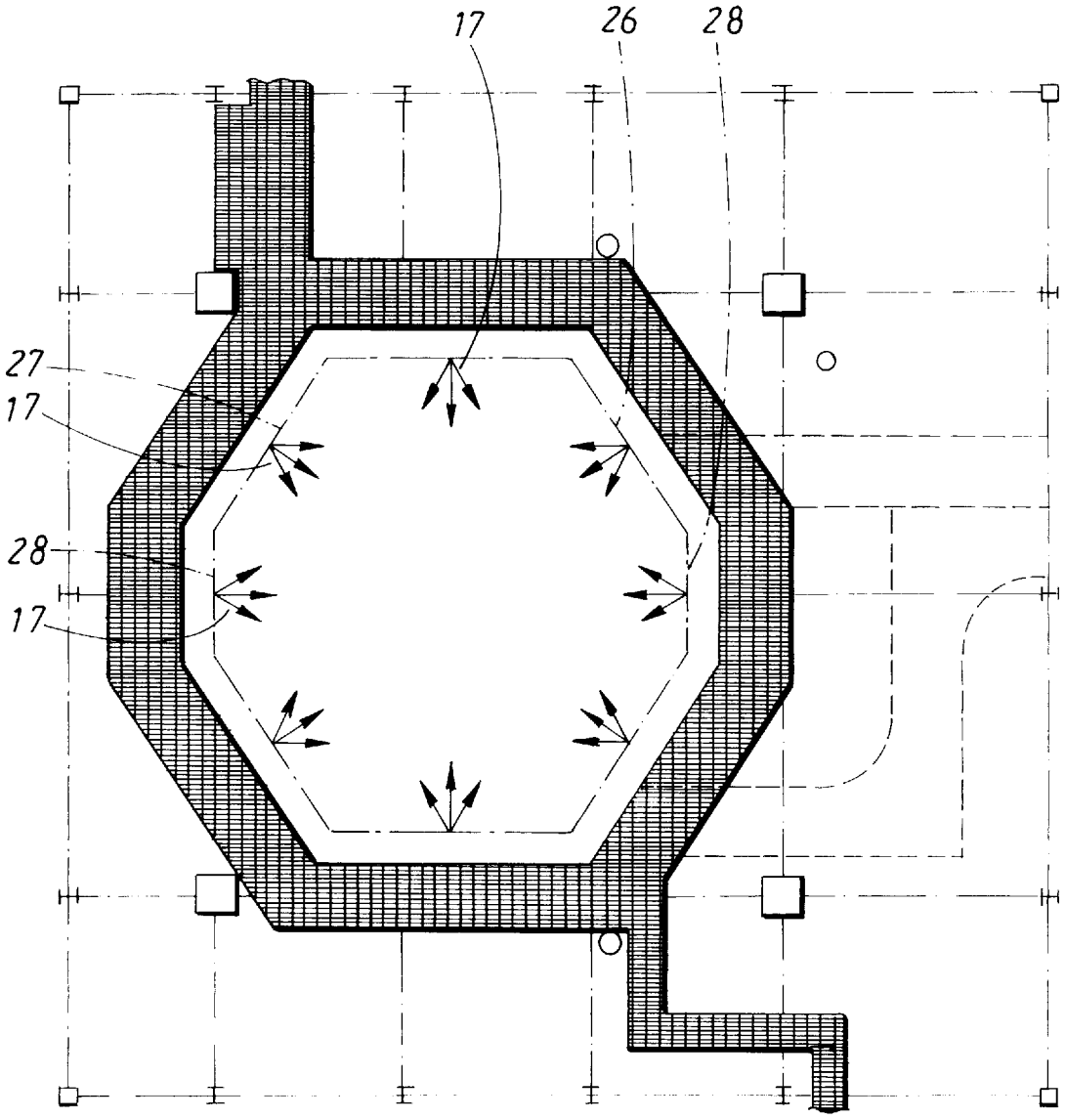

FIG. 4 shows a section at the level for liquor injection in the upper part of the first lower level of the recovery boiler. As can be seen, the cross-section is octagonal, with eight sets of injection nozzles 17, one at the middle of each side. The sides of the octagon need not be of identical length, and in the Figure the sides 26 and 27 are slightly longer than the sides 28. There is therefore no right angle in the octagon where the vertical pipes would be able to "hide", and instead all the pipes are virtually equal as regards the heat transfer from the furnace to the water in the pipes.

Figure 5:
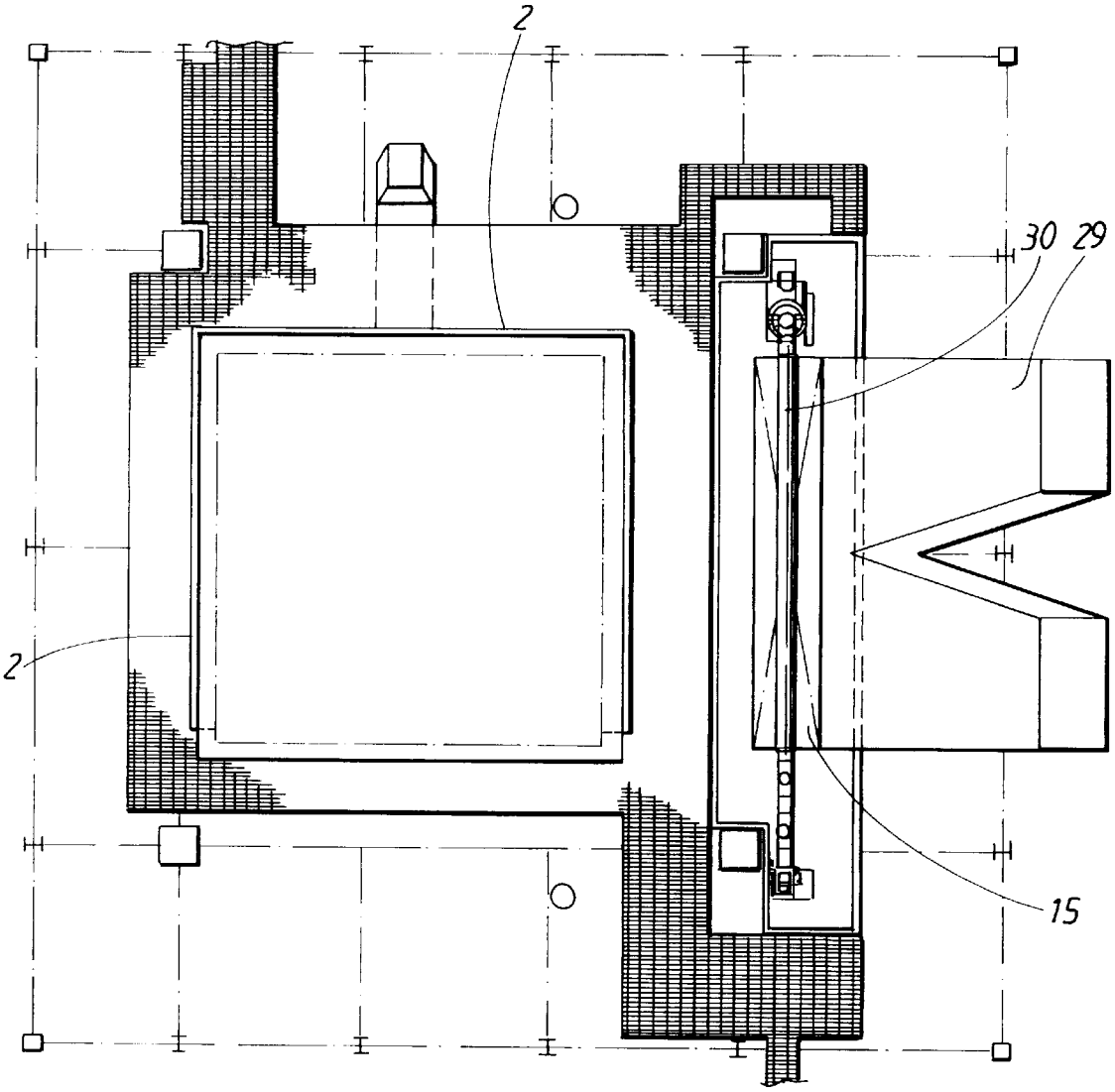
FIG. 5 shows a section higher up in the boiler where the latter is square and where the lowermost part of the channels for the outgoing combustion gas is shown.

FIG. 5 shows a section in the upper part 2 at the level lying immediately above the point where the upper part 2 begins to merge with the lower part 1. As can be seen, the section through the furnace is square.

The lower part 29 of the flue gas channels in the final cooling stage 12 is indicated on the right side of the Figure. The channel 29 for the flue gases can divide in two or more parts from the funnel-shaped part 15. Situated horizontally in this funnel-shaped part 15 is a discharge screw 30 for discharging dust and other substances which have been separated from the flue gas and have collected in the funnel 15.

The present invention has thus provided a recovery boiler which has better properties than the former conventional recovery boilers. The widened lower part of the furnace allows for a lower gas speed, with a resultant favourable separation and precipitation of molten drops, and in addition the pipes are not shadowed in a corner and as a result permit a more uniform and quicker through-flow of water. Furthermore, the economic aspects of the recovery boiler have been improved as a result of the more efficient cooling of the flue gases leaving the boiler. The combustion air can also be added more evenly since the boiler has a rounder shape than the conventional boilers. The rounder shape is especially advantageous if it is wished to rotate the combustion air and gases in the lower part of the furnace, so-called rotation firing.

The V-shaped design or the base, with distribution box or channel in the middle, means that each individual pipe has a shorter distance associated with the base. This too leads to a safer construction with less risk of so-called burnout.

The base is cooled by a greater flow of water than in conventional cases, which also improves the safety. This is due to the fact that a greater proportion of wall pipes are connected to the base compared to an entirely square boiler.

The invention is not limited to the embodiment shown, but instead can be varied in different ways within the scope of the patent claims. Thus, one advantageous embodiment may have a completely circular cross-section in the lower part 1.

I claim:

1. A recovery boiler for combustion of waste liquors from cellulose production, comprising:

a furnace having a base and walls which include a plurality of liquid-cooled tubes wherein the base constitutes a collection location for inorganic substances in molten form; and means for introducing air and waste liquor into the furnace so that combustion gases are conveyed upwards in the boiler;

wherein said furnace is divided into separate, upper and lower parts the cross-sectional area of the lower part exceeding the cross-sectional area of the upper part, and a circumference of a cross-section at the first and second parts is substantially the same.

2. A recovery boiler according to claim 1, wherein a number of the plurality of wall tubes in the lower part is substantially the same as a number of the plurality of tubes in the upper part.

3. A recovery boiler according to claim 2, wherein a number of the plurality of wall tubes in the lower part is identical to the number of the plurality of tubes in the upper part.

4. A recovery boiler according to any one of claims 1 to 3, wherein the cross-section of the upper part exhibits one of a substantially rectangular and square shape, and wherein the cross-section of the lower part is polygonal, with more than four sides.

5. A recovery boiler according to claim 4 wherein the number of sides is six.

6. A recovery boiler according to claim 4 wherein the number of sides is eight.

7. A recovery boiler according to any one of claims 1 to 3, wherein pipes along the walls run vertically, and wherein pipes which are placed in corners of the upper part are situated, in the lower part, along an unbroken surface and at a shorter distance from a center line extending vertically in the furnace than in the upper part.

8. A recovery boiler according to any of claims 1 to 3, wherein the lower part represents about ¼ of a total height of the recovery boiler.

9. A recovery boiler according to any one of claims 1 to 3, wherein the collection location in the base for the inorganic substances in molten form has the shape of an open, upwardly directed V.

10. A recovery boiler according to claim 9, wherein outlets from the base are arranged at both ends of the upwardly directed V.

11. A recovery boiler according to any one of claims 1 to 3, wherein a final part of cooling flue gases is designed in two stages, the flue gases in a first stage flowing along the pipes in a heat exchanger with vertical, water-filled pipes, while in a final, second stage the flue gases flow across horizontal pipes in a similar heat exchanger.

12. A recovery boiler according to claim 11, wherein the final, second stage has an inlet directly connected to the outlet of the first stage.

13. A recovery boiler according to claim 12, wherein the final stage includes at least several pipe assemblies, which are arranged one after the other in the direction of the flue gases.

14. A recovery boiler according to claim 13, wherein at least the final stage is supported from below and is therefore not suspended.

* * * * *